US008740484B2

(12) United States Patent
Sato et al.

(10) Patent No.: US 8,740,484 B2
(45) Date of Patent: Jun. 3, 2014

(54) IMAGE-FORMING DEVICE AND METHOD FOR FORMING AN IMAGE WHICH DETECTS SHIFTING AMOUNTS OF A CONTINUOUS RECORDING MATERIAL

(75) Inventors: Ryuichi Sato, Nagano (JP); Yujiro Nomura, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 198 days.

(21) Appl. No.: 13/420,921
(22) Filed: Mar. 15, 2012
(65) Prior Publication Data

US 2012/0240803 A1 Sep. 27, 2012

(30) Foreign Application Priority Data

Mar. 23, 2011 (JP) ..... 2011-064435

(51) Int. Cl.

| | |
|---|---|
| ***B41J 11/42*** | (2006.01) |
| ***B65H 9/00*** | (2006.01) |
| ***B41J 13/26*** | (2006.01) |
| ***B65H 23/02*** | (2006.01) |
| ***B65H 23/032*** | (2006.01) |
| *B41F 13/02* | (2006.01) |

(52) U.S. Cl.
CPC *B41J 11/42* (2013.01); *B41J 13/26* (2013.01); *B65H 9/00* (2013.01); *B65H 23/0216* (2013.01); *B65H 23/032* (2013.01); *B41F 13/025* (2013.01)
USPC ..... 400/619; 400/76; 400/579; 226/3; 226/15; 347/104

(58) Field of Classification Search
CPC ..... B41J 11/42; B41J 13/26; B41J 13/32; B65H 9/00; B65H 9/20; B65H 23/0216; B65H 23/02; B65H 23/032; B65H 7/10; G03G 15/6567; G03G 15/6558; G03G 2215/00561; B41F 1/34; B41F 13/025
USPC ..... 101/485, 486, 481; 400/619, 630, 633, 400/579; 399/301, 394, 395; 226/3, 15, 21, 226/22, 23
See application file for complete search history.

(56) References Cited

U.S. PATENT DOCUMENTS

| | | | | |
|---|---|---|---|---|
| 3,570,735 | A * | 3/1971 | Kurz | 226/3 |
| 7,390,133 | B2 | 6/2008 | Hatayama | |
| 7,448,745 | B2 | 11/2008 | Kibayashi | |
| 2003/0116042 | A1 * | 6/2003 | Ohba et al. | 101/225 |
| 2008/0124158 | A1 * | 5/2008 | Folkins | 399/396 |
| 2012/0006215 | A1 * | 1/2012 | DeJong et al. | 101/481 |

FOREIGN PATENT DOCUMENTS

| | | | |
|---|---|---|---|
| JP | 2006-142632 | A | 6/2006 |
| JP | 2006-264934 | A | 10/2006 |

* cited by examiner

*Primary Examiner* — Daniel J Colilla
*Assistant Examiner* — Blake A Tankersley
(74) *Attorney, Agent, or Firm* — Global IP Counselors, LLP

(57) ABSTRACT

An image-forming device includes a conveying part, an image-forming part, first through third sensors, and a control part. The conveying part is configured and arranged to convey a continuous recording material. The image-forming part is configured and arranged to form an image on the recording material conveyed by the conveying part. The first through third sensors are configured and arranged to detect positions of an edge surface of the recording material conveyed by the conveying part. The control part is configured to calculate first through third shifting amounts based on the positions of the edge surface of the recording material simultaneously detected by the first through third sensors, respectively. The first shifting amount is generated by movement of the recording material, the second shifting amount is generated by rotation of the recording material, and the third shifting amount is generated by fluctuations in the edge surface of the recording material.

9 Claims, 9 Drawing Sheets

IMAGE-FORMING DEVICE AND METHOD FOR FORMING AN IMAGE WHICH DETECTS SHIFTING AMOUNTS OF A CONTINUOUS RECORDING MATERIAL

CROSS-REFERENCE TO RELATED APPLICATIONS

This application claims priority to Japanese Patent Application No. 2011-064435 filed on Mar. 23, 2011. The entire disclosure of Japanese Patent Application No. 2011-064435 is hereby incorporated herein by reference.

BACKGROUND

1. Technical Field

The present invention relates to an image-forming device and a method for forming an image, in which image-forming heads are used to form a picture on a recording material, and particularly relates to an image-forming device and a method for forming an image in which a picture is formed on a continuous recording material.

2. Related Art

Image-forming devices for conveying paper, cloth, or another recording material and using image-forming parts of a plurality of colors arranged in parallel in the conveying direction to form an image on the recording material are well known. In such an image-forming device, shifting of the printing position in the conveying direction of the recording material results in color shifting, and therefore the timing of printing between the image-forming parts is controlled. Color shifting is also generated when the recording material meanders in the widthwise direction of the recording material, i.e., the direction perpendicular to the conveying direction of the recording material, while being conveyed.

Japanese Laid-Open Patent Application No. 2006-142632 describes meander correction in a duplex printing device for printing on both sides of paper, cloth, or another webbing material (recording material). Specifically, a first edge guide (meander-correcting mechanism) and a first edge sensor are positioned upstream of a first-surface printing part for printing on one surface of the webbing. The first edge guide is moved and meandering of the webbing is corrected according to the amount of shifting from the target position for the edge of the webbing as detected by the first edge sensor. A second edge guide and a second edge sensor are also positioned downstream of the first-surface printing part. The second edge guide is moved according to the amount of shifting detected by the second edge sensor in the same manner as for the upstream side of the webbing.

SUMMARY

However, in the device disclosed in Japanese Laid-Open Patent Application No. 2006-142632, when the edge position fluctuates due to molding irregularities, nap, or the like on the edge of the webbing (recording material), the webbing may be moved more than necessary in the widthwise direction between the color inkjet bars arranged in parallel within the first-surface printing part, and printing shifting (color shifting) is generated between the inkjet bars.

Additionally, in this device, the first edge guide is moved using the shifting detected by the first edge sensor, and the second edge guide is moved using the shifting detected by the second edge sensor, and therefore, when the image formed by the inkjet bar positioned upstream reaches the inkjet bar positioned downstream, the corresponding position of the image formed by the inkjet bar is inappropriate, and color shifting is generated in the same manner.

It is an object of the present invention to accurately detect the conveyance state when a recording material is continuously conveyed in such an image-forming device.

In order to solve these problems, an image-forming device according to a first aspect of the present invention includes a conveying part, an image-forming part, first through third sensors, and a control part. The conveying part is configured and arranged to convey a continuous recording material. The image-forming part is configured and arranged to form an image on the recording material conveyed by the conveying part. The first through third sensors are configured and arranged to detect positions of an edge surface of the recording material conveyed by the conveying part. The control part is configured to calculate first through third shifting amounts based on the positions of the edge surface of the recording material simultaneously detected by the first through third sensors, respectively. The first shifting amount is generated by movement of the recording material, the second shifting amount is generated by rotation of the recording material, and the third shifting amount is generated by fluctuations in the edge surface of the recording material.

In the image-forming device of the above described aspect of the present invention, the first through third shifting amounts are preferably in a direction perpendicular to a conveying direction of the recording material.

The image-forming device of the above described aspect of the present invention preferably further includes a recording material position-adjusting part configured and arranged to adjust a position of the recording material in a direction perpendicular or substantially perpendicular to a conveying direction of the recording material conveyed by the conveying part. The control part is preferably configured to control the recording material position-adjusting part based on at least one of the first shifting amount and the second shifting amount.

In the image-forming device of the above described aspect of the present invention, the first through third sensors are preferably disposed upstream of a position at which the image is formed by the image-forming part with respect to a conveying direction of the recording material.

In the image-forming device of the above described aspect of the present invention, the conveying part preferably includes two rollers configured and arranged to hold the recording material tense at the position at which the image is formed by the image-forming part, and the first through third sensors are preferably disposed between the two rollers.

The image-forming device of the above described aspect of the present invention preferably further includes a rotation-amount-detecting part configured and arranged to detect a rotational amount of one of the two rollers. The control part is preferably configured to control an image-forming timing of the image-forming part based on the detected rotational amount.

In the image-forming device of the above described aspect of the present invention, the rotation-amount-detecting part is preferably configured and arranged to detect the rotational amount of the roller downstream in a conveying direction of the recording material.

A method for forming an image on a continuous recording material that is conveyed according to another aspect of the present invention includes: detecting positions of an edge surface of the conveyed recording material by first through third sensors; and calculating a first shifting amount, a second shifting amount, and a third shifting amount based on the positions of the edge surface of the recording material, the first shifting amount being generated by movement of the recording material, the second shifting amount being generated by rotation of the recording material, the third shifting amount being generated by fluctuations in the edge surface of the recording material, and the positions being simultaneously detected by the first sensor, the second sensor, and the third sensor, respectively.

According to the aspects of the present invention as described above, positions of the edge surface of the recording material are simultaneously detected by the first through third sensors. The first shifting amount generated by movement of the recording material, the second shifting amount generated by rotation of the recording material, and a third shifting amount generated by fluctuations in the edge surface of the recording material are calculated based on the positions obtained for the edge surface, and the conveyance condition of the recording material can be accurately ascertained.

Using these calculation results allows the third shifting amount, which is generated by irregularities in the recording material, to be eliminated, and allows meander correction of the recording material to be performed based on the first shifting amount or the second shifting amount, which are the primary causes of meandering of the recording material.

BRIEF DESCRIPTION OF THE DRAWINGS

Referring now to the attached drawings which form a part of this original disclosure.

DETAILED DESCRIPTION OF EXEMPLARY EMBODIMENTS

Figure 1:
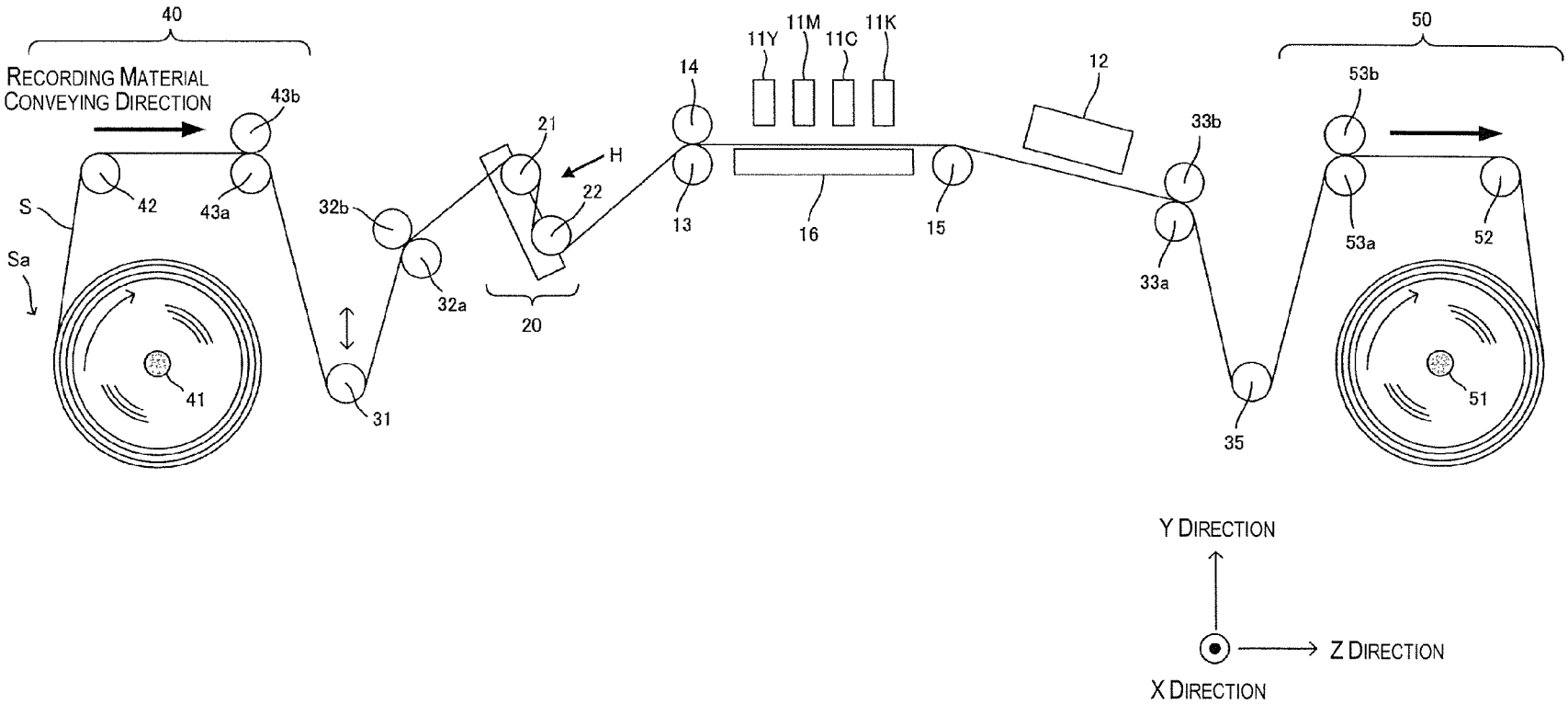
FIG. 1 shows the overall configuration of an image-forming device according to an embodiment of the present invention.

An embodiment of the present invention will be described with reference to the drawings. FIG. 1 shows the configuration of an image-forming device according to an embodiment of the present invention. The image-forming device according to the present embodiment uses photo-curing ink and is of a format involving a process in which ink is discharged from image-forming heads 11 onto a recording material S, then irradiated with light, and thereby fixed. Ultraviolet rays are employed as the light used in the present embodiment.

FIG. 1 is a lateral view of the image-forming device. As shown in FIG. 1, the direction in which the recording material S is carried is the Z direction, and the widthwise direction of the recording material S is the X direction. The primary configuration of the image-forming device includes color image-forming heads 11Y, 11M, 11C, 11K for forming (printing) pictures on the recording material S, and a conveying part comprising various rollers and the like for conveying the recording material S. Besides paper, label sheets, and cloth, plastic film and the like can be used as the recording material S.

The conveying part of the present embodiment is configured having, e.g., a feeder 40 for conveying the recording material S, which has been rolled up in a recording material roll Sa, toward the image-forming heads 11; a winder 50 for rolling up and collecting the recording material S upon which images have been formed by the image-forming heads 11; a meander-correcting part 20 for correcting conveyance shifting in the widthwise direction of the recording material S; a dancer roller 31 for preventing slackening of the recording material S carried out from the feeder 40; and a dancer roller 35 for preventing slackening of the recording material S near the winder 50.

The recording material S is carried out from the feeder 40, passes various rollers, and receives the ink discharged from the image-forming heads 11, after which the ink is irradiated by ultraviolet rays from a UV irradiator 12 (light-irradiating part) and fixed on the recording material S. The recording material is then collected into the winding part 50.

A continuous conveyance format in which conveyance is performed at a constant speed is employed for conveying the recording material S using the conveying part, i.e., conveying the recording material S for passing the lower surfaces of the image-forming heads 11. Besides this format, an intermittent conveying format may also be used. This format repeatedly alternates between conveying and stopping, and pictures are formed on the recording material by the image-forming heads 11Y through 11K when stopping.

The meander-correcting part 20 (the recording material position-adjusting part of the present invention) is a mechanism for correcting positional shifting in the widthwise direction (the X direction) of the recording material S, i.e., the direction perpendicular or substantially perpendicular to the conveying direction of the recording material S. The group of a front roller 21 and a rear roller 22 rotates, whereby the conveyed recording material S is moved in the widthwise direction, and the pictures printed on the recording material S by the image-forming heads 11Y through 11K are corrected to the proper position. The details of the configuration and control of this system are described in detail hereinafter.

A driving roller 13, a counter roller 14, and a driven roller 15 form a recording surface on which a picture is formed by the image-forming heads 11Y through 11K. The recording material S is held in tension between these rollers, whereby the recording surface is formed. In the present embodiment, the conveying speed of the recording material S is controlled by the driving of the driving roller 13 positioned upstream of the image-forming heads 11. A stepping motor or the like capable of positional control or constant-speed control is therefore used for driving the driving roller 13.

A suction part 16 for pulling the recording material S in the reverse direction from the image-forming heads 11 is provided to the region below the recording surface formed by the driving roller 13 and the driven roller 15. An air-aspirating-type suction part 16 is used in the present embodiment, but, additionally, an electrostatic suction type may also be used. Besides a flat (platen) shape, the shape employed for the surface of the suction part 16 along which the recording material S passes may make an arc bending toward the image-forming heads 11 or be a variety of other shapes.

The UV irradiator 12 functions to irradiate ultraviolet rays and cure the UV-curable ink discharged onto the recording material S. The configuration is such that the light source of the UV irradiator 12 is, e.g., a UV-LED (ultraviolet light emitting diode) for producing ultraviolet rays. Metal halide lamps, xenon lamps, carbon arc lamps, chemical lamps, low-pressure mercury lamps, high-pressure mercury lamps, and like may also be used as the light source.

Figure 2:
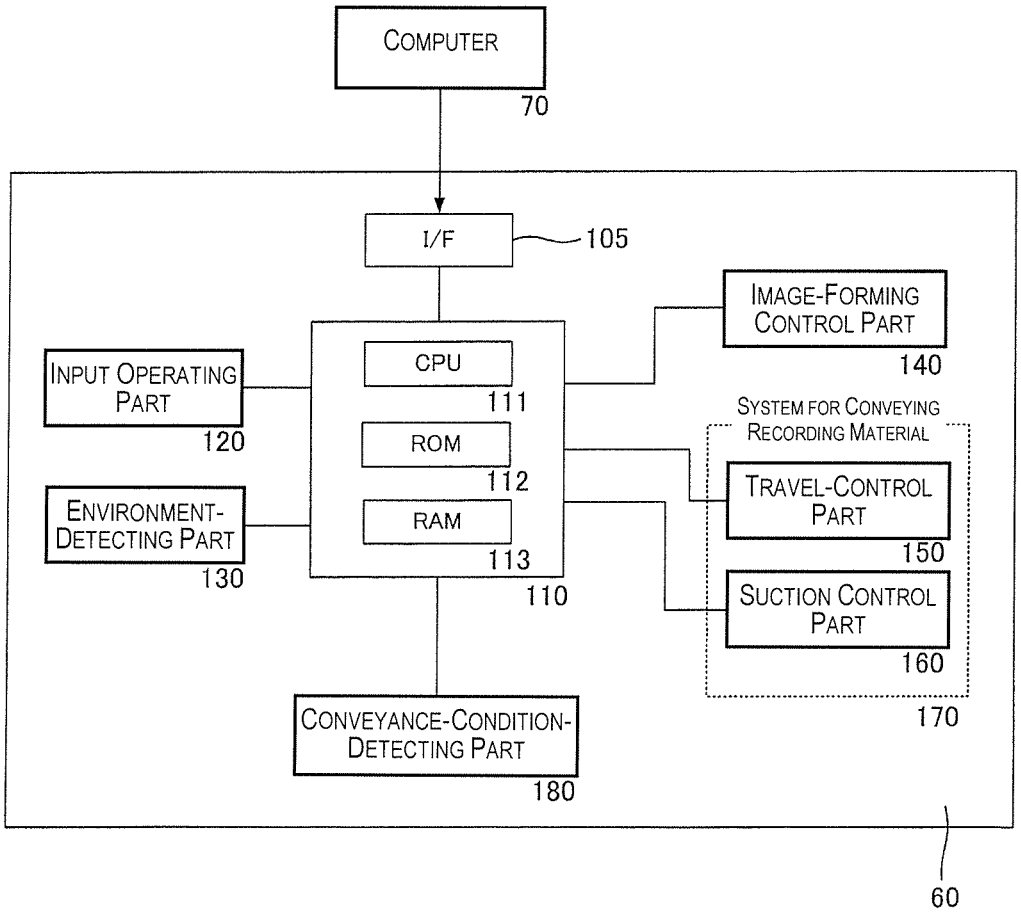
FIG. 2 shows the control configuration of the image-forming device according to an embodiment of the present invention.

FIG. 2 shows the control configuration of the image-forming device according to the embodiment of the present invention. A central control part 110 in this control configuration is composed of, e.g., a CPU 111, a ROM 112, and a RAM 113. A process program recorded in the ROM 112 is deployed in the RAM 113. The process program is executed by the CPU 111. An interface 105 is provided for connecting the central control part 110 of an image-forming device 60 and a computer 70.

The central control part 110 controls an image-forming control part 140, a travel-control part 150 that acts a control part 170 for the recording material-conveying system, and a suction control part 160 according to the process program. The central control part controls the various control parts based on various information received from an input operating part 120 to which various settings are input by a user; an environment-detecting part 130 provided with various sensors for detecting temperature, humidity, and the like in the external environment; and a conveyance-condition-detecting part 180 for detecting the condition of conveyance of the recording material S.

Figure 3:
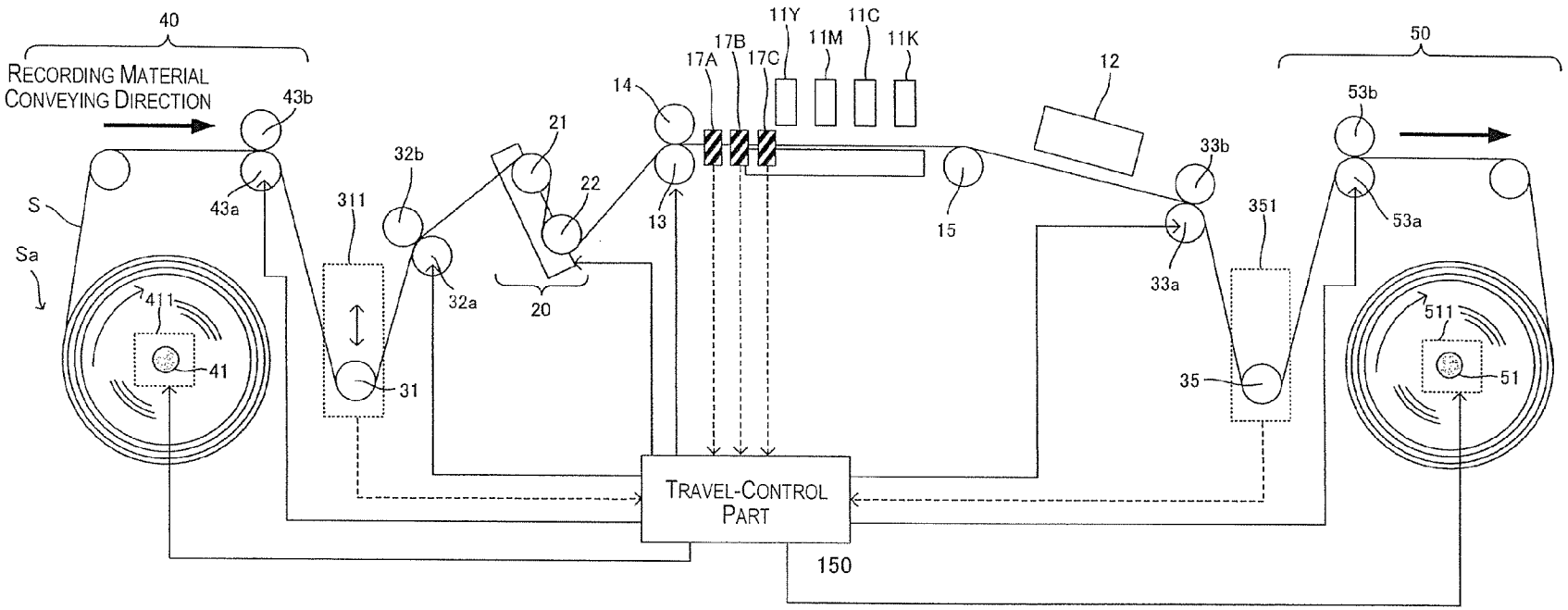
FIG. 3 shows the control configuration of the recording material-conveying system of the image-forming device according to an embodiment of the present invention.

FIG. 3 shows the control configuration of the recording material-conveying part of the image-forming device according to the embodiment of the present invention. The travel-control part 150 controls various driving systems related to conveying the recording material S. A motor or the like, which acts as a driving means provided to driving rollers 13, 43*a*, 53*a*, tension rollers 32*a*, 33*a*, and a winding shaft 51, is driven to rotate, whereby the recording material S is conveyed. Rubber rollers or other elastic rollers are employed so as to allow the driving force of the driving rollers to be conveyed to the counter rollers 14, 32*b*, 33*b*, 43*b*, 53*b* positioned opposite the corresponding driving rollers.

A powder brake 411 that acts as a rotation-inhibiting means is provided to a winding shaft part 41. Tension is applied to the recording material S by imparting a force for pulling the recording material S back in the direction opposite the conveying direction.

The dancer roller 31 can operate at various heights and provides a constant load to the recording material S that is fed out from the feeder 40. The driving roller 43*a* is driven based on the vertical position of the dancer roller 31 as detected by a dancer-roller position-detecting part 311. The length (buffer amount) of the recording material S between the first roller 43*a* and the tension roller 32*a* is kept within a predetermined range. The dancer roller 31 in the present embodiment is used to provide a buffer to the recording material S, whereby slack in the recording material S as generated by errors in the various travel systems is absorbed, and the travel characteristics of the recording material S can be made more favorable. The dancer roller 35, a dancer-roller position-detecting part 351, and a driving roller 53*a* are also provided in the same manner to the winder 50 side, and conveyance control is executed in the same manner as the feeder 40.

The meander-correcting part 20 in the present embodiment is provided for correcting conveyance shifting of the recording material S in the widthwise direction. In the present embodiment, the disposed position of the image-forming heads 11, i.e., positional shifting when forming the image on the recording material S, is particularly problematic. Three edge sensors 17A, 17B, 17C (the "sensors" in the present invention) are provided to a portion (recording surface) held in tension by the driving roller 13 and the driven roller 15, and the positions of the edge surface of the recording material S are simultaneously detected. The positions of the edge surface (edge) of the recording material S as simultaneously detected by the edge sensors 17A, 17B, 17C are input to the travel-control part 150 and used in calculations for the amount of correction in the meander-correcting part 20. "Simultaneous" here not only signifies exact simultaneity but also includes substantial simultaneity.

Figure 4:
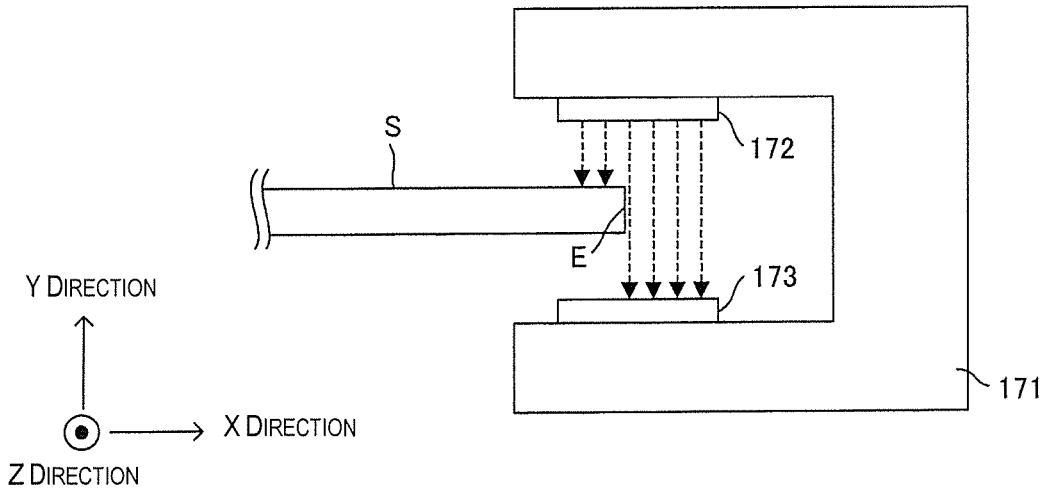
FIG. 4 shows the configuration of the edge sensor according to an embodiment of the present invention.

FIG. 4 shows the configuration of the first (second, third) edge sensor 17A (B, C) according to the embodiment of the present invention. These edge sensors 17 detect a position E of the edge surface of the conveyed recording material S. Optical-type sensors are employed in the present embodiment. All of the sensors 17A, 17B, 17C have the same configuration and are configured having a supporting member 171, a light-emitting part 172, and a light-receiving part 173. The light-emitting part 172 and the light-receiving part 173 are disposed facing each other on the supporting member 171. The position E of the edge surface of the recording material S passes through the interval where the light-emitting part 172 and the light-receiving part 173 face each other. Light emitted from the light-emitting part 172 is partially obscured by the recording material S passing through that interval, and the position E of the edge surface of the recording material can be detected using the amount of light received at the light-receiving part 173. Instead of a sensor in which the light-emitting part 172 and the light-receiving part 173 are used for detection using light, a sensor that makes use of an oscillating part and a signal-receiving part that use sound waves (ultrasonic waves) may also be used. Alternatively, a mechanical sensor may also be used, in which a contact for lightly contacting the position E of the edge surface of the recording material is used.

The meander-correcting part 20 is controlled, and positional shifting of the recording material S in the widthwise direction is minimized in the present embodiment based on information on the positions of the edge surface as outputted from the first edge sensor 17A, the second edge sensor 17B, and the third edge sensor 17C that detect the positions of the position E of the edge surface of the recording material S using this arrangement.

FIG. 5 shows the configuration and operation of the meander-correcting part 20 according to the embodiment of the present invention. FIG. 5 is a schematic of the view from the side shown by the arrow H in the image-forming device shown in FIG. 1. Differences exist with the actual appearance of the conveyance of the recording material S in FIG. 5 in order to facilitate understanding. As depicted in FIG. 1, the meander-correcting part 20 is configured having the front roller 21 and the rear roller 22. The rollers 21, 22 are rotatably supported, and the rolled up recording material S is conveyed in the conveying direction shown in FIG. 5 (the downward direction in FIG. 5).

The meander-correcting part 20 is further provided with revolving shafts 212, 222, a frame 23, and revolving-shaft-supporting parts 211, 221. The front roller 21 is provided with the revolving shaft 212 on both ends, and the revolving shaft 212 is revolvably affixed to the frame 23 by the revolving-shaft-supporting part 211. The revolving shaft 222 provided on both ends of the rear roller 22 is revolvably affixed to the frame 23 by the revolving-shaft-supporting part 221 in the same fashion. The other ends of the rollers 21, 22 are also rotatably affixed to the frame 23. On the other hand, a rotational fulcrum 231 is provided to the frame 23, and the configuration allows rotation about this point. The rotation of the frame 23 thus causes the front roller 21 and the rear roller 22, which are disposed on the same frame 23, to rotate in the same direction. The rotation of the frame 23 is controlled by a meander-correcting actuator (not shown), whereby meander correction is executed for the recording material S.

Figure 5B:
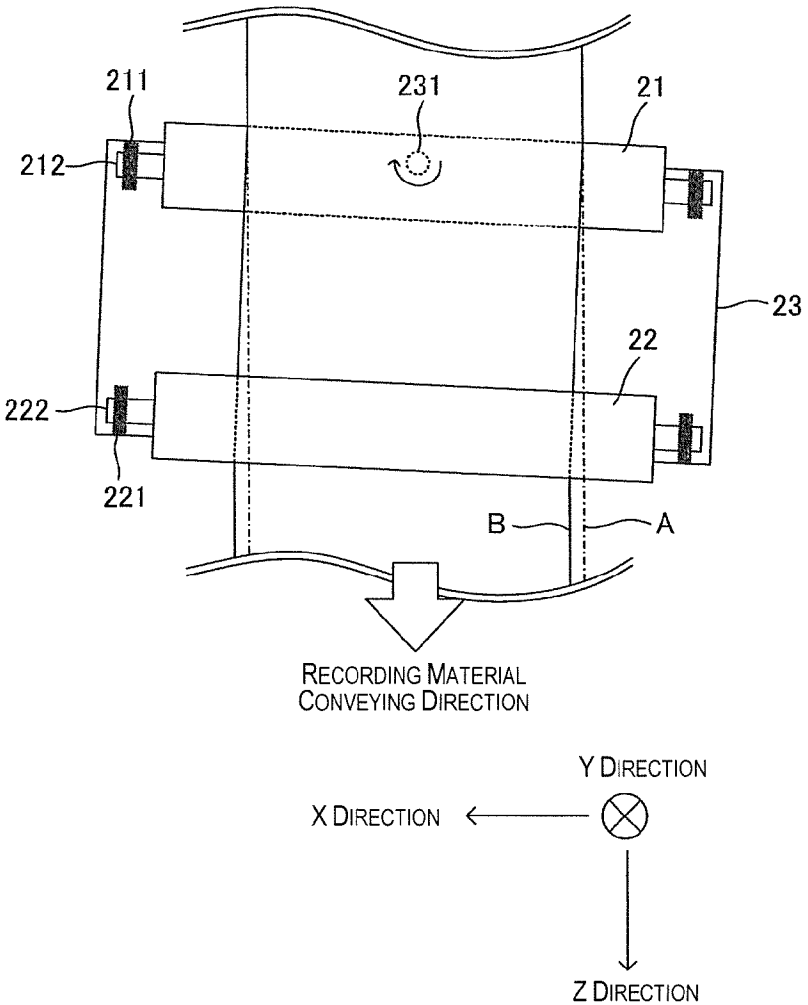
FIGS. 5A and 5B show the configuration and operation of the meander-correcting part according to an embodiment of the present invention.
Figure 5A:
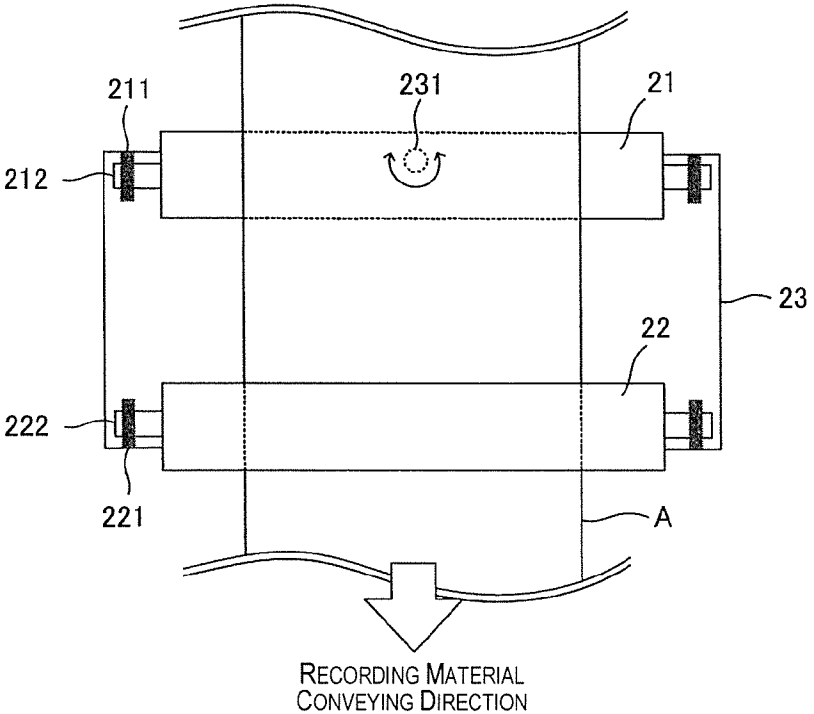

FIG. 5B shows the appearance during meander correction. The appearance shown is when the frame 23 is rotating clockwise. The edge surface of the recording material S at the time point of FIG. 5A is additionally shown using the dotted line A, but it can be seen that the recording material moves in the leftward direction, as shown by the solid line B, according to the rotation of the frame 23. The frame 23 in the present embodiment is made to rotate based on information on the positions of the edge surface as outputted from the three aforedescribed first through third edge sensors 17A, 17B, 17C, and the conveying position of the recording material S is adjusted to the appropriate position.

Figure 6:
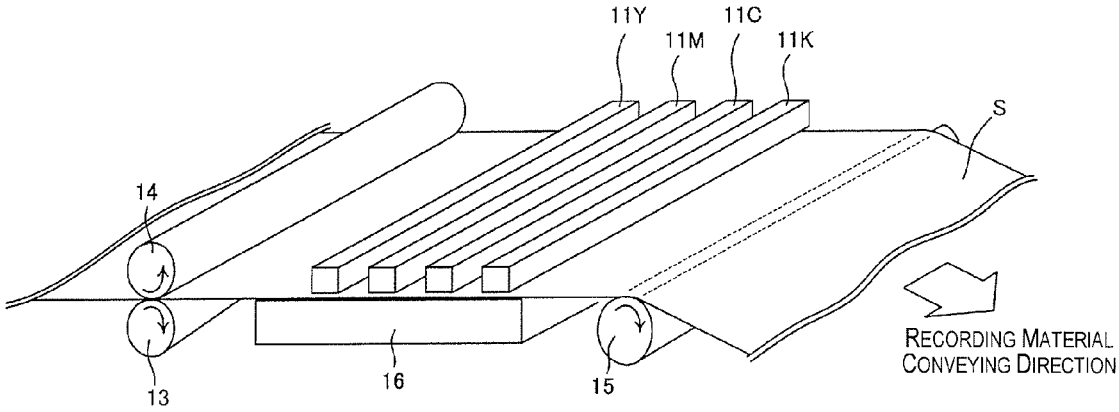
FIG. 6 is a perspective view that shows the configuration of the image-forming part according to an embodiment of the present invention.
Figure 7:
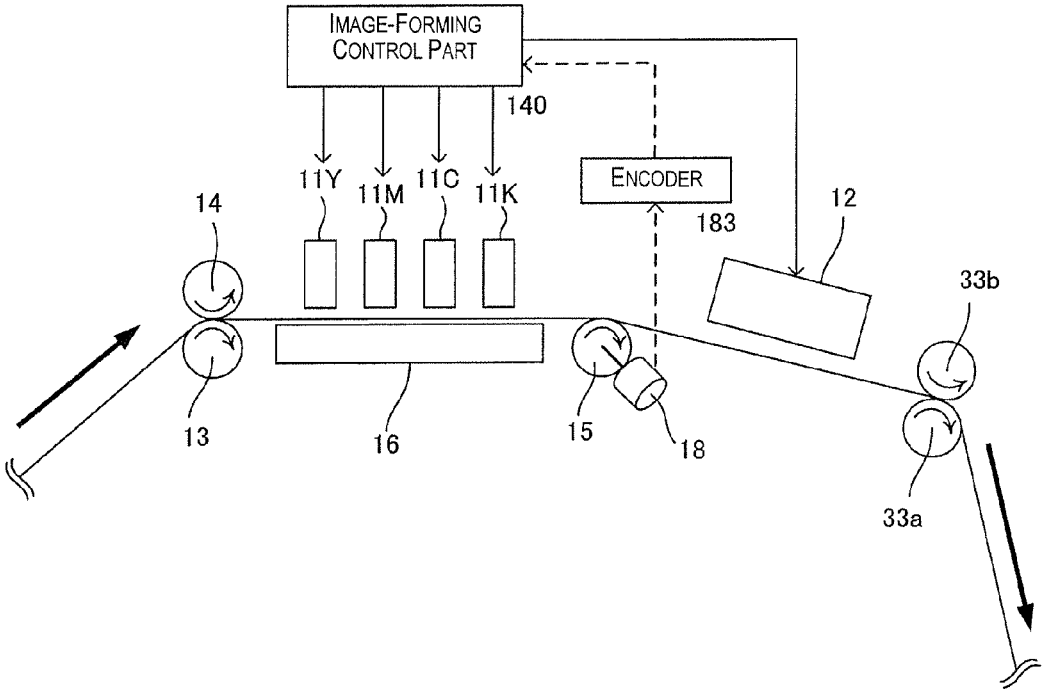
FIG. 7 shows the control configuration of the image-forming system of the image-forming device according to an embodiment of the present invention.

An embodiment of the image-forming part for forming images in the present invention will be described next. FIG. 6 is a perspective view showing the configuration of the image-forming part according to the embodiment of the present invention. FIG. 7 shows the control configuration of the image-forming part of the image-forming device according to the embodiment of the present invention.

As shown in FIG. 6, the image-forming device according to the embodiment of the present invention is configured provided with the plurality of the image-forming heads 11Y through 11K for discharging the UV-curable ink. These four image-forming heads 11Y through 11K discharge ink of the colors Y (yellow), M (magenta), C (cyan), and K (black), respectively, onto the recording material S and form pictures. The image-forming heads 11Y through 11K in the present embodiment are arranged in parallel along the entirety of the widthwise direction so as to allow printing on the entire area of the recording material S. Ink is discharged in the order of the respective image-forming heads 11Y, 11M, 11C, 11K, whereby the ultimate image is formed. After the ink is fixed by the UV irradiator 12, the recording material S is collected by the winder 50.

The recording material S that is sandwiched by the driving roller 13 and the counter roller 14 is conveyed by the rotation of the driving roller 13. The driven roller 15 that allows smooth rotation using bearings and the like without a drive system is provided downstream of the image-forming heads 11. The portion (recording surface) of the recording material S that is held in tension by the driving roller 13 and the driven roller 15 is suctioned and conveyed by the suction part 16, and pictures are formed using the colored inks discharged from the image-forming heads 11.

The ink discharged onto the recording material S passes the driven roller 15 and is fixed by the UV irradiator 12, but the driven roller 15 functions to separate the recording surface onto which ink has been discharged by the image-forming heads 11 and the fixing surface onto which ultraviolet rays are irradiated by the UV irradiator 12. Separating the recording surface and the fixing surface of the recording material S using the driven roller 15 minimizes the extent to which contraction of the recording material S affects the recording surface, where this contraction results from the effects of contraction of the ink during ultraviolet irradiation and the effects of the heat of the ink reaction.

Other rollers such as the counter roller 14 are not provided to the driven roller 15 for conveying the recording material S when carrying unfixed ink, and the recording material S is conveyed without disturbing the ink thereon. The driven roller 15 also functions as the conveyance-condition-detecting part used for detecting the amount of conveyance of the recording material S and preferably rotates so as to follow the recording material S. A metal roller is therefore used for the driven roller 15, and the surface is worked so as to have a high friction coefficient.

The driven roller 15 thus ideally rotates following the conveyance of the recording material S and is preferably made to come into adequate contact with the recording material S; i.e., the extent of wrapping is large. On the other hand, the unfixed ink adhering to the recording material S will run when the extent of the wrapping of the recording material S is large, and the image being formed may be disturbed. Therefore, in the present embodiment, the recording surface that is held in tension by the driving roller 13 and the driven roller 15 is kept in a horizontal or substantially horizontal direction, and the fixing surface that is held in tension by the driven roller 15 and the tension roller 33*a* is set to an acute angle with respect to the conveying direction of the recording material, whereby the driven roller 15 is made to follow the recording material S, and travel of the unfixed ink is minimized.

FIG. 7 shows the control configuration of the image-forming part according to the embodiment of the present invention. As described above, the driven roller 15 of the present embodiment also functions as a conveyance-condition-detecting part for detecting the amount of conveyance of the recording material S. The ink-discharge timing of the image-forming heads 11Y through 11K is controlled in the image-forming control part 140 based on the output of a rotary encoder 18 connected to the driven roller 15. The speed at which the recording material S is conveyed in the present embodiment is controlled by the driving roller 13 positioned upstream of the image-forming heads 11, but the recording material S sandwiched by the drive systems may slip, and the speed transmitted to the driving roller 13 may be different from the conveyance speed of the recording material S in such cases. The conveyance speed is therefore detected using the driven roller 15 in the present embodiment.

Figure 8:
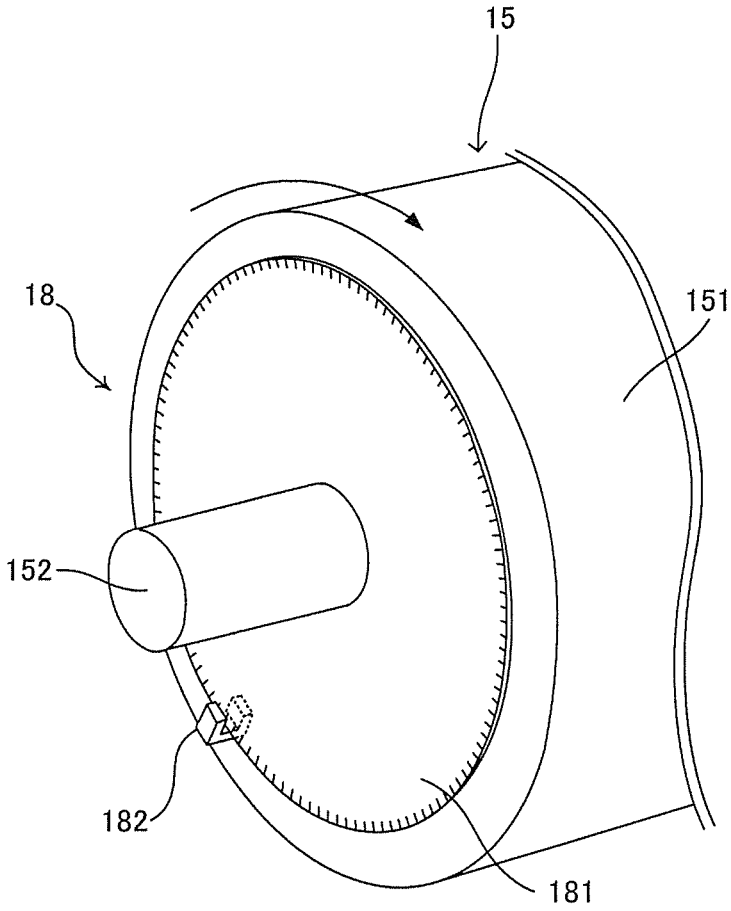
FIG. 8 shows the configuration of the rotary encoder according to an embodiment of the present invention.

The rotary encoder 18 (the "rotation-amount-detecting part" in the present invention) will now be described. The rotary encoder is a primary configurational component of the conveyance-condition-detecting part 180 used in the present embodiment. FIG. 8 depicts the rotary encoder 18. The rotary encoder 18 has a rotating disc 181, which has a plurality of slits provided at predetermined intervals, and a detecting part 182. The rotating disc 181 is affixed to a rotating shaft 152 of the driven roller 15 and rotates according to the rotation of the driven roller 15. The detecting part 182 is affixed to the frame or other part of the image-forming device 60.

Every time the slits provided to the periphery of the rotating disc 181 in the rotary encoder 18 pass the detecting part 182, a pulse signal ENC is outputted to the central control part 110. An encoder 183 ascertains the rotational angle and rotational speed of the driven roller 15 based on the pulse signal ENC, whereby the conveyance condition (conveyance speed, conveyance position) of the recording material S can be ascertained.

Figure 9:
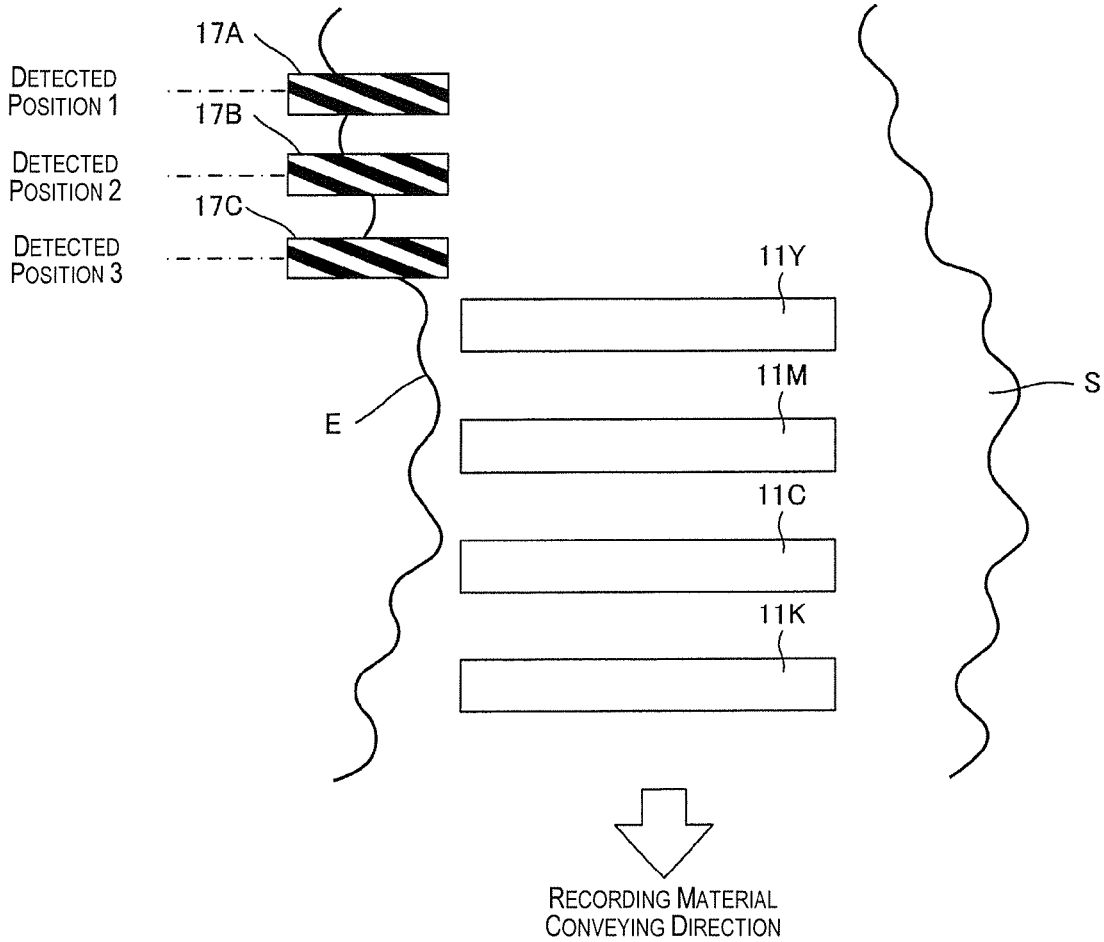
FIG. 9 shows the positioning of the edge sensor according to an embodiment of the present invention.

The disposition of the recording material S, the first edge sensor 17A, the second edge sensor 17B, the third edge sensor 17C, and the image-forming heads 11Y through 11K will be described using FIG. 9. FIG. 9 is a top view in which the conveyed recording material S is viewed from the forward direction Y in FIG. 1. The appearance of the position E of the recording material S is drawn in an exaggerated fashion in FIG. 9 to facilitate understanding. The edge surface E of the recording material S has an undulating shape, as shown in FIG. 9, due to molding irregularities, nap, or other irregularities of the edge surface E of the recording material. In other words, fluctuations resulting from molding irregularities, nap, and like in the edge surface E of the recording material S in particular cannot be handled in cases where the position of the edge surface E of the recording material S is detected using a single edge sensor.

The amount of shifting resulting from these types of fluctuations in the edge surface E of the recording material S are detected in the present embodiment. It is again noted that the shifting amount generated by meandering of the recording material is divided into a shifting amount produced by the recording material S moving in a direction perpendicular to the conveying direction thereof and a shifting amount generated by rotation of the recording material S. These three amounts of shifting are analyzed based on the output of the three edge sensors 17A through 17C.

The three edge sensors 17A through 17C are used in the present embodiment due to the presence of the three shifting amounts, which are uncertain components. The three edge sensors 17A through 17C are positioned upstream of the image-forming heads 11Y through 11K in the conveying direction of recording material S in the present embodiment in order to minimize shifting in the position at which the picture is formed by the image-forming heads 11Y through 11K. The position at which the edge sensors 17A, 17B, 17C are disposed is preferably between the driving roller 13 and the driven roller 15 that hold the recording material S in tension and form the recording surface. According to this configuration, positions of the edge surface that will actually produce color shifting are detected and meander correction is performed by the meander-correcting part 20 at the position at which the recording material S is held in tension, whereby the position of the recording material can be adjusted.

Figure 10:
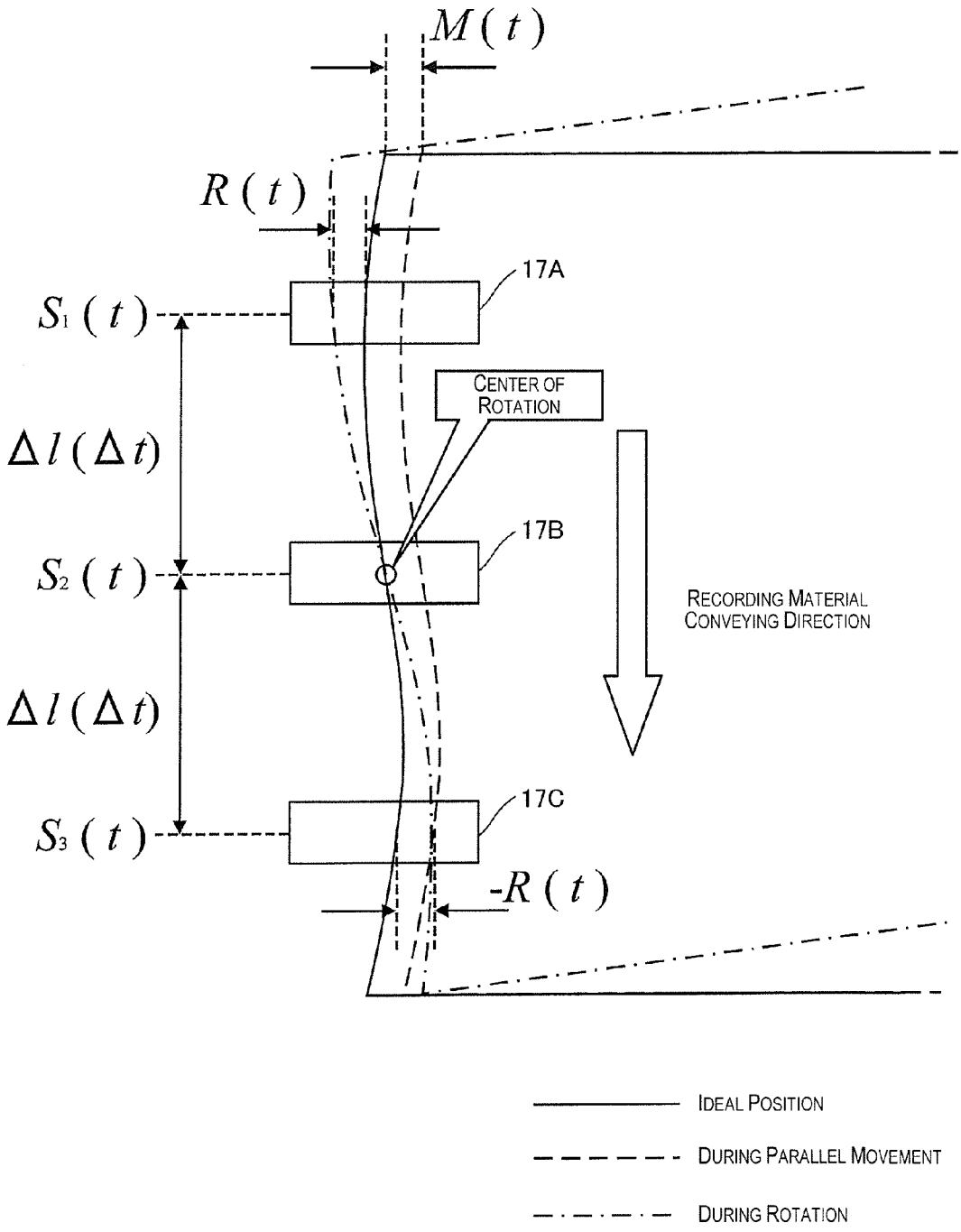
FIG. 10 depicts the calculation of the amount of shifting of the recording material according to an embodiment of the present invention.

FIG. 10 depicts the calculation of the shifting amounts of the recording material according to the embodiment of the present invention. In FIG. 10, the ideal position (solid line), a position (broken line) displaced in parallel from the ideal position, and a position (dashed-dotted line) rotated from the ideal position of the same recording material S are shown. The actual position of the recording material S is a quantity that results from adding these two meander components to the fluctuations of the edge surface E. The shifting amounts in the direction perpendicular to the conveying direction of the recording material S as produced by meandering can be given as fluctuating functions of time t: the amount of shifting due to parallel movement is M(t), the amount of shifting due to rotation is R(t), and the amount of shifting due to fluctuations of the edge surface E is P'(t). The three edge sensors 17A through 17C are disposed at equal intervals Δ1. The intervals at which the edge sensors 17A through 17C are disposed can be determined as appropriate. In such cases, calculations are executed while taking the disposition intervals into account.

Positions S1(*t*) through S3(*t*) of the edge surface E of the recording material S as detected by the edge sensors 17A through 17C can be given by equations (1) through (3) based on the definitions above.

Equation (1)

$$S_1(t)=P'(t+2\Delta t)+M(t)+R(t) \tag{1}$$

Equation (2)

$$S_2(t)=P'(t+\Delta t)+M(t) \tag{2}$$

Equation (3)

$$S_3(t)=P'(t)+M(t)-R(t) \tag{3}$$

When t is changed to t−Δt in equation (1), equation (4) can be obtained.

Equation (4)

$$S_1(t-\Delta t)=P'(t+\Delta t)+M(t-\Delta t)+R(t-\Delta t) \tag{4}$$

Subtracting equation (4) from equation (2) allows equation (5) to be obtained.

Equation (5)

$$S_2(t)-S_1(t-\Delta t)=M(t)-M(t-\Delta t)-R(t-\Delta t) \tag{5}$$

When t is changed to t−Δt in the same fashion for equation (2), Equation (6) can be obtained.

Equation (6)

$$S_2(t-\Delta t)=P'(t)+M(t-\Delta t) \tag{6}$$

Subtracting equation (6) from equation (3) allows equation (7) to be obtained.

Equation (7)

$$S_3(t)-S_2(t-\Delta t)=M(t)-M(t-\Delta t)-R(t) \tag{7}$$

When equation (7) is subtracted from equation (5) thus obtained, equation (8) is obtained, but in observing the right side of equation (8), it is seen that there is a difference in the shifting amount resulting from the rotation during the time Δt. This is divided by Δt, whereby a rotational speed Vr(t) given by equation (9) below can be obtained.

Equation (8)

$$-S_1(t-\Delta t)+S_2(t)+S_2(t-\Delta t)-S_3(t)=R(t)-R(t-\Delta t) \tag{8}$$

Equation (9)

$$Vr(t)=\frac{R(t)-R(t-\Delta t)}{\Delta t}=\frac{-S_1(t-\Delta t)+S_2(t)+S_2(t-\Delta t)-S_3(t)}{\Delta t} \tag{9}$$

The rotational speed Vr(t) is time integrated, whereby the shifting amount R(t) generated by rotation can be determined as shown by equation (10) below.

Equation (10)

$$R(t)=\int Vr(t)dt \tag{10}$$

On the other hand, in observing the right side of equation (7), it is seen that the previously determined R(t) is present, and a difference in the amount of shifting resulting from movement during the time Δt is present. When R(t) is transposed as shown in equation (11), and division by Δt is performed, a movement speed Vm(t) can be obtained as shown in equation (12) below.

Equation (11)

$$M(t) - M(t - \Delta t) = S_3(t) - S_2(t - \Delta t) + R(t) \quad (11)$$

Equation (12)

$$Vm(t) = \frac{M(t) - M(t - \Delta t)}{\Delta t} = \frac{S_3(t) - S_2(t - \Delta t) + R(t)}{\Delta t} \quad (12)$$

The movement speed Vm(t) thus obtained can also be time integrated in the same manner as the rotational speed Vr(t), whereby a shifting amount M(t) resulting from movement can be determined as shown in equation (13).

Equation (13)

$$M(t)=\int Vm(t)dt \quad (13)$$

The shifting amount M(t) determined using equation (13) is applied to equation (6), whereby the shifting amount resulting from fluctuations in the edge surface E is determined as P'(t) as shown in equation (14).

Equation (14)

$$P'(t)=S_2(t-\Delta t)-M(t-\Delta t) \quad (14)$$

In the present embodiment as described above, the three edge sensors 17A through 17C are used to detect the positions of the edge surface of the recording material S, whereby the shifting amount P'(t) resulting from fluctuations in the edge surface E as produced by nap in the edge surface of the recording material S, processing irregularities, and other irregularities in the recording material S can be detected, and meander correction in which the shifting amount P'(t) has been eliminated can be executed in the meander-correcting part 20. The meandering of the recording material S as generated in the actual travel system can also be analyzed by separating the shifting amount resulting from parallel motion into M(t) and the shifting amount resulting rotation into R(t); e.g., using these analysis results allows correction control to be performed according to the meander components.

The meander-correcting part 20 described using FIG. 5 causes rotation of the frame 23 that rotatably supports the two rollers 21, 22. In other words, the rotational angle is the primary correction parameter, but, e.g., the temporal response of the rotational angle is changed according to the shifting amount M(t) resulting from parallel movement and the shifting amount R(t) resulting from rotation even using this format for the meander-correcting part 20, whereby correction of the shifting amounts M(t), R(t) can be handled. The meander-correcting part 20 is not limited to the format described in the present embodiment. Any format having a driving mechanism capable of separately correcting for the shifting amount M(t) resulting from parallel movement and for the shifting amount R(t) resulting from rotation may be used.

Various embodiments were described in the present specification, but embodiments configured from appropriate combinations of the respective configurations of the embodiments also fall under the category of the present invention.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. An image-forming device comprising:

a conveying part configured and arranged to convey a continuous recording material;

an image-forming part configured and arranged to form an image on the recording material conveyed by the conveying part;

a first sensor configured and arranged to detect a position of an edge surface of the recording material conveyed by the conveying part;

a second sensor configured and arranged to detect a position of the edge surface of the recording material conveyed by the conveying part;

a third sensor configured and arranged to detect a position of the edge surface of the recording material conveyed by the conveying part; and a control part configured to calculate a first shifting amount, a second shifting amount, and a third shifting amount based on the positions of the edge surface of the recording material, the first shifting amount being generated by movement of the recording material, the second shifting amount being generated by rotation of the recording material, the third shifting amount being generated by fluctuations in the edge surface of the recording material, the positions being simultaneously detected by the first sensor, the second sensor, and the third sensor, respectively, the second shifting amount being calculated based on the positions detected by the first sensor, the second sensor, and the third sensor, the first shifting amount being calculated based on the second shifting amount and the positions detected by the second sensor and the third sensor, and the third shifting amount being calculated based on the first shifting amount and the position detected by the second sensor.

2. The image-forming device according to claim 1, wherein the first through third shifting amounts are in a direction perpendicular to a conveying direction of the recording material.

3. The image-forming device according to claim 1, further comprising a recording material position-adjusting part configured and arranged to adjust a position of the recording material in a direction perpendicular or substantially perpendicular to a conveying direction of the recording material conveyed by the conveying part, wherein the control part is configured to control the recording material position-adjusting part while eliminating the third shifting amount.

4. The image-forming device according to claim 3, wherein the control part is further configured to control the recording material position-adjusting part based on at least one of the first shifting amount and the second shifting amount.

5. The image-forming device according to claim 1, wherein the first through third sensors are disposed upstream of a position at which the image is formed by the image-forming part with respect to a conveying direction of the recording material.

6. The image-forming device according to claim 1, wherein the conveying part includes two rollers configured and arranged to hold the recording material tense at the position at which the image is formed by the image-forming part, and the first through third sensors are disposed between the two rollers.

7. The image-forming device according to claim 6, further comprising a rotation-amount-detecting part configured and arranged to detect a rotational amount of one of the two rollers, wherein the control part is configured to control an image-forming timing of the image-forming part based on the detected rotational amount.

8. The image-forming device according to claim 7, wherein the rotation-amount-detecting part is configured and arranged to detect the rotational amount of the one of the two rollers that is disposed downstream relative to the other of the two rollers in a conveying direction of the recording material.

9. A method for forming an image on a continuous recording material that is conveyed, comprising:

detecting positions of an edge surface of the conveyed recording material by first through third sensors; and calculating a first shifting amount, a second shifting amount, and a third shifting amount based on the positions of the edge surface of the recording material, the first shifting amount being generated by movement of the recording material, the second shifting amount being generated by rotation of the recording material, the third shifting amount being generated by fluctuations in the edge surface of the recording material, the positions being simultaneously detected by the first sensor, the second sensor, and the third sensor, respectively, the second shifting amount being calculated based on the positions detected by the first sensor, the second sensor, and the third sensor, the first shifting amount being calculated based on the second shifting amount and the positions detected by the second sensor and the third sensor, and the third shifting amount being calculated based on the first shifting amount and the position detected by the second sensor.

* * * * *